United States Patent [19]

Mitchell

[11] 4,454,691

[45] Jun. 19, 1984

[54] APPARATUS FOR INSULATING WINDOWS AND THE LIKE

[76] Inventor: Robert A. Mitchell, R.D. #1, Box 462-A, Voorheesville, N.Y. 12186

[21] Appl. No.: 308,169

[22] Filed: Oct. 2, 1981

[51] Int. Cl.[3] ..... E06B 3/26; E05B 65/04

[52] U.S. Cl. ..... 52/202; 160/107; 160/117; 49/62

[58] Field of Search ..... 52/202, 203, 71; 49/62, 49/59-61, 63, 65, 67; 160/107, 117

[56] References Cited

U.S. PATENT DOCUMENTS

| | | | |
|---|---|---|---|
| 1,823,237 | 9/1931 | Caesar | 49/61 |
| 2,320,069 | 5/1943 | Cresswell | 52/203 |
| 2,612,947 | 10/1952 | Jenks | 52/203 |
| 3,214,879 | 11/1965 | Ellingson | 52/202 |
| 3,422,878 | 1/1969 | Galietti | 160/231 A |
| 4,057,936 | 11/1977 | Wyatt | 49/61 |
| 4,221,091 | 9/1980 | Ganse | 49/61 |
| 4,272,934 | 6/1981 | Cowoden | 52/202 |
| 4,355,676 | 10/1982 | Lee | 49/62 |

FOREIGN PATENT DOCUMENTS

| | | | |
|---|---|---|---|
| 2459017 | 6/1976 | Fed. Rep. of Germany | 52/202 |
| 1,561,785 | 3/1980 | United Kingdom | 52/71 |

*Primary Examiner*—John E. Murtagh

[57] ABSTRACT

Apparatus for insulating window openings through walls and the like includes a thermal shutter, a rail for mounting the shutter adjacent to the window opening and a coupling for connecting the shutter to the rail. The thermal shutter includes an insulated panel adhered to frame members which surround the periphery of the panel. The frame members include a hard portion for providing the frame and a soft portion for providing a seal with that portion of the wall adjacent to the periphery of the opening. The coupling means is preferably integral with the attachment rail.

According to a preferred embodiment, the coupling means includes a continuous hinge of reduced thickness. The thermal shutter can be permanently attached, hinged, bi-folded, or sliding with respect to the window and wall. A distribution method is to market the apparatus in "kit" form.

30 Claims, 11 Drawing Figures

APPARATUS FOR INSULATING WINDOWS AND THE LIKE

This invention was made with the Government support under DE-FG02-80CS30531 awarded by the Department of Energy. The Government has certain rights in this invention.

BACKGROUND OF THE INVENTION

1. Field of the Invention

The instant invention relates to apparatus for insulating windows and similar openings in buildings. More particularly, the instant invention relates to thermal shutters for insulating windows and similar openings through building walls.

2. Prior Art and Other Considerations

Residential and commercial space heating account for approximately twenty percent of the total national energy consumption in the United States. An estimated one-quarter to one-third of this consumption is attributable to heat losses through windows. Accordingly, about five percent of the total national energy consumption literally flows out of windows and is wasted. According to some estimates, this amounts to approximately four quadrillion btu's per year which is equivalent to approximately 700 million barrels of oil. The total fuel cost to consumers due to window heat loss is in excess of twelve billion dollars per year. To the individual homeowner or commercial building owner, reductions in heat loss through windows are immediately apparent in monthly bills.

As is readily apparent from disclosures such as that of U.S. Pat. No. 4,221,091, issued Sept. 9, 1980, there is a paucity of solutions to the problem of insulating window areas. These solutions all contain major shortcomings that the current invention cures. The subject of U.S. Pat. No. 4,221,091 is essentially a fixed exterior framing system for window insulation. It is composed of a great variety of pieces that combine in a complex manner to form a stationary object, resulting in high prices for installation. The subject of U.S. Pat. No. 4,212,289 is not really a window insulating system at all, but a solar collector disguised as a window shutter. The subject of U.S. Pat. No. 4,068,428 is simply an interior storm window. The subject of U.S. Pat. No. 4,194,550 is typical of roll-up fabric window insulation. It must be factory cut and then delivered to the site. Furthermore, as with all roll-up systems, it is impossible to achieve an effective infiltration seal along the perimeter. The subject of U.S. Pat. No. 4,115,953 is an assembly of a great many standard lumberyard components. It depends on expensive sliding door hardware, and calls upon the installer to apply weatherstripping to the completed assembly. It is a difficult construction subject to warping and a resultant failure of the seals.

Since there are an enormous number of existing structures having window areas which need insulation, the problem must be approached and solved on a retrofit basis. This requires that the installations should be compatible with existing structures and should be both inexpensive and relatively easy to install. Preferably, existing technology with plant capacity already in existence should be relied upon in order to expedite utilization of the solution.

In order to be widely adopted, there are certain constraints that a solution to this problem must contend with. For example, the apparatus should be operable from inside a building and should not be aesthetically displeasing, or at least should be as unobtrusive as possible. Moreover, the system should be easy to remove when not needed as well as being easy to install.

In designing such an apparatus, one needs to keep in mind that it is advantageous to admit sunlight in order to warm a building during the day in cool, temperate climates and to insulate windows during the evening in order to prevent the loss of heat accumulated in the building by sunlight and other means. On the other hand, during hot weather, it is frequently desirable to block sunlight from entering the building during the day and to uncover windows during the night so that a building will remain cool. It should be kept in mind that buildings in climates which have warm summers and cool winters need to operate in both modes.

In order to enhance ease of installation, the apparatus should be relatively light in weight. In order to have a long and useful life, the apparatus should be strong and durable. Moreover, the apparatus should be safe and should not present a fire hazard. If the apparatus is locked in place, one should be able to quickly remove it and open a window for both light and egress. In essence, the apparatus should not interfere to any great extent with the normal operation and function of windows while at the same time minimizing the thermal drain of windows.

SUMMARY OF THE INVENTION

In view of the aforementioned considerations, it is a feature of the instant invention to provide new and improved apparatus for insulating windows wherein the apparatus can be installed on an existing window and wherein the apparatus is configured so that it will be widely accepted and utilized.

In view of the aforementioned feature, the instant invention contemplates apparatus for insulating openings through building walls, which apparatus includes means for attaching the apparatus to the surface of the wall adjacent the periphery of the opening and shutter means secured to the attaching means for overlying the opening to provide a thermal barrier. The shutter means includes a fire-resistant panel and a frame which surrounds the panel. The frame includes a relatively stiff portion which couples to the attaching means and a relatively soft or flexible portion which forms a seal with the wall surface adjacent to the window. Coupling means is provided to secure the shutter to the attaching means for selected movement between a position overlying the opening to a position displaced from the opening.

The instant invention further contemplates a fire-resistant foam core for the panel, which core is disposed between a pair of skins which are reinforced to provide both bending and impact strength. Alternatively, the instant invention contemplates a honeycomb core sandwiched between at least a pair of skins. The honeycomb can be constructed of foilfaced paper, or paper with another low infra-red emmittance coating.

DESCRIPTIONS OF THE PREFERRED EMBODIMENT

Figure 1:
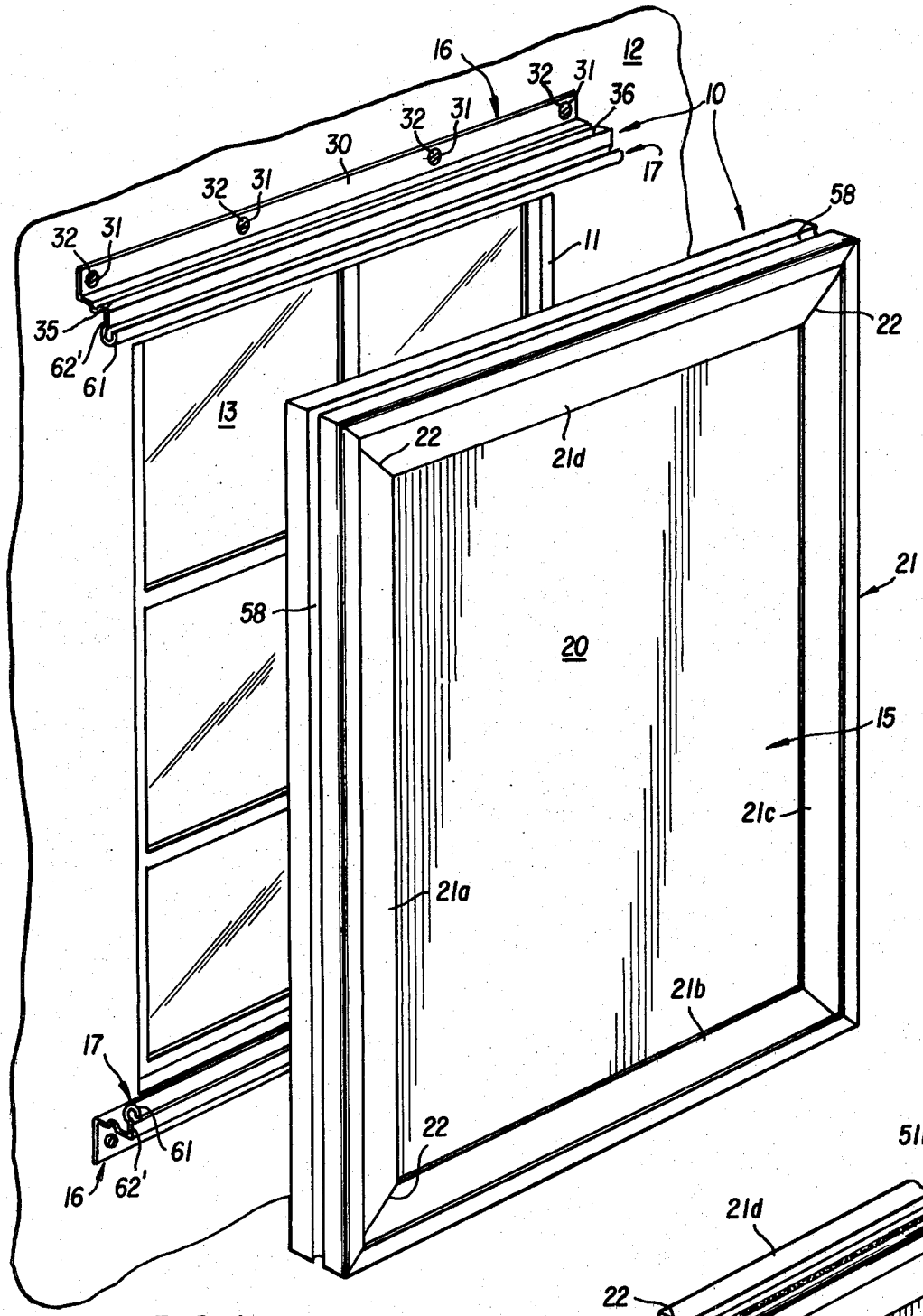
FIG. 1 is a perspective view of apparatus in accordance with the instant invention wherein a thermal shutter is used to insulate a window.

Referring now to FIG. 1, there is shown apparatus, designated generally by the numeral 10, for thermally insulating an opening 11 through a wall 12, which opening surrounds a window 13. The apparatus 10 is preferably applied to the inner surface of the wall 12. The apparatus 10 includes three basic components, namely, a shutter, designated generally by the numeral 15; an attachment rail, designated generally by the numeral 16, and a coupling, designated generally by the numeral 17, which couples the shutter to the attachment rail.

Figure 3:
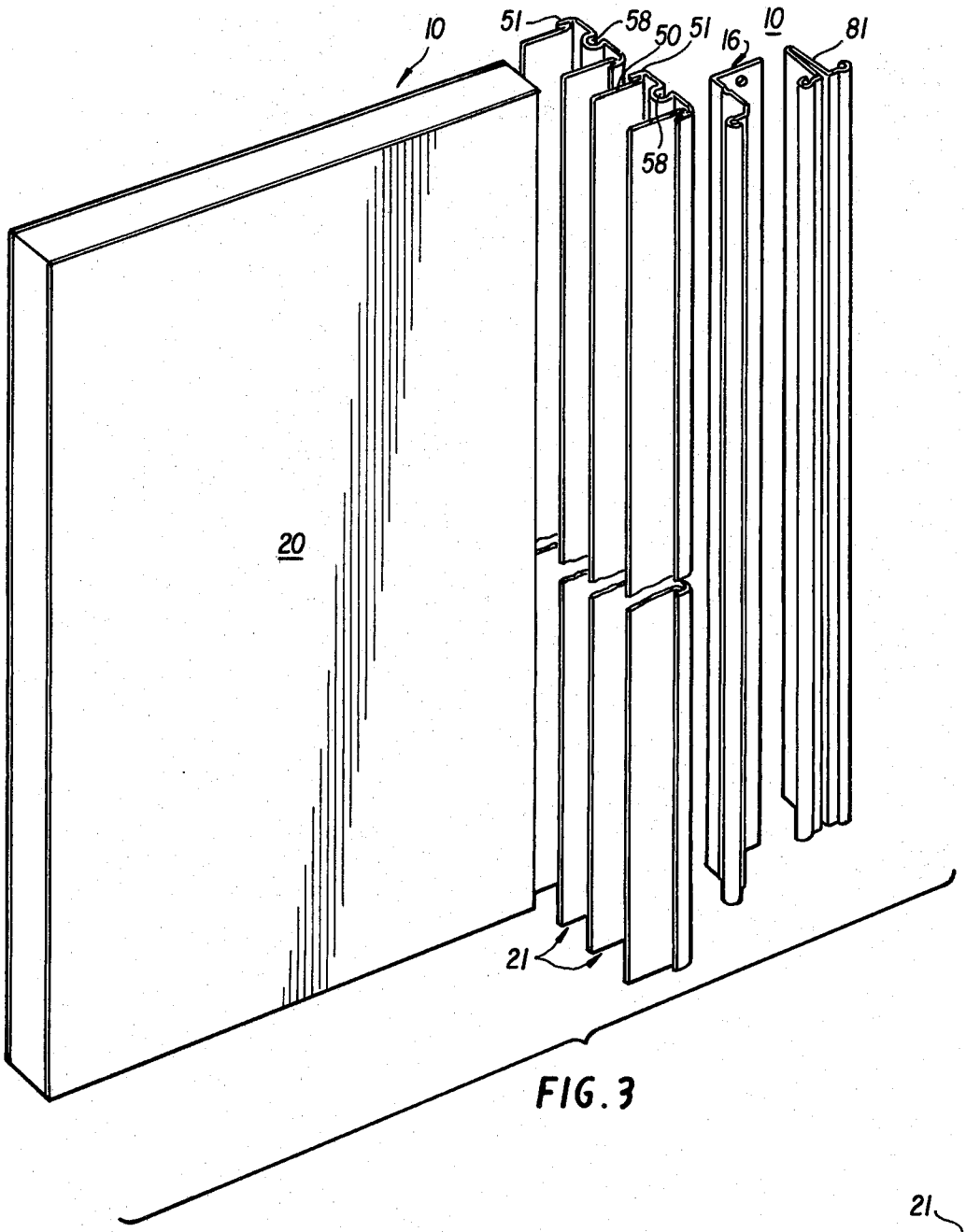
FIG. 3 is a planar perspective view showing the components of a kit for assembling the apparatus shown by example in the other Figure and other apparatus not shown but capable of being assembled from the kit.
Figure 9:
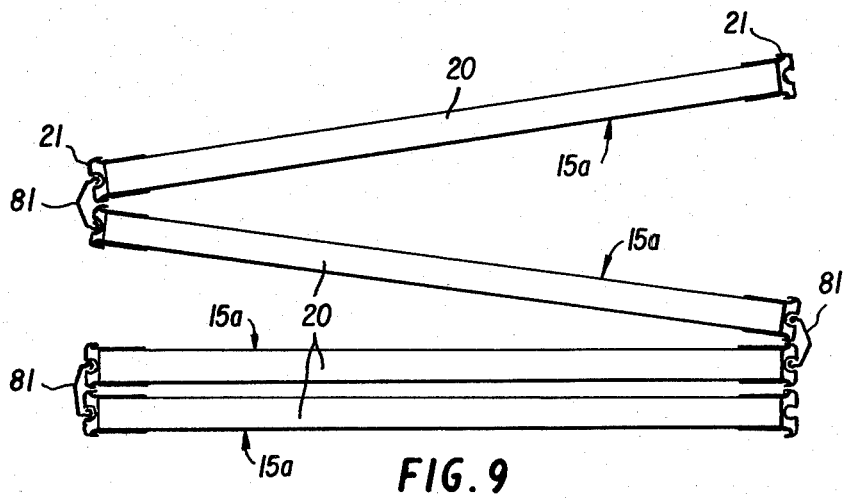
FIG. 9 is a schematic side view showing the apparatus of the instant invention configured as a "Roman shade".
Figure 7:
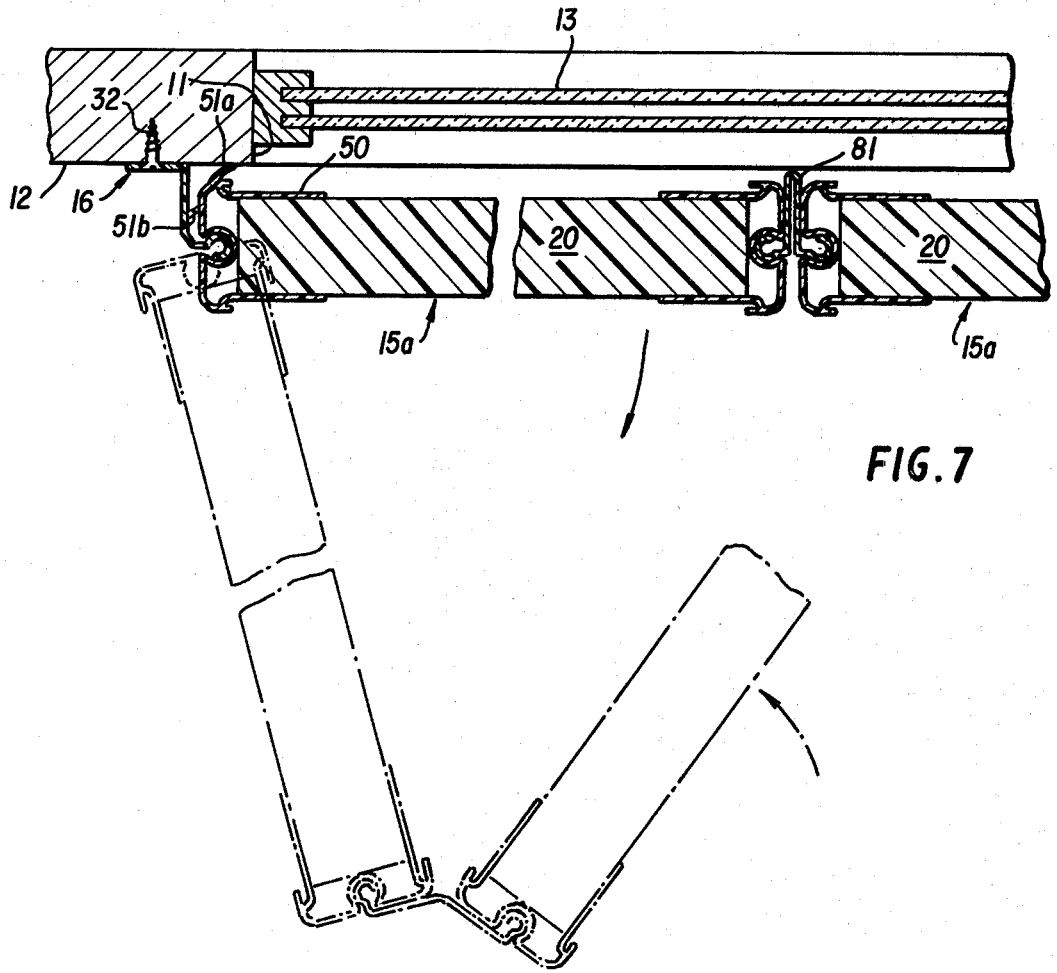
FIG. 7 is a view similar to FIG. 6 showing utilization of the hinge of FIG. 5 to form a shutter assembly which extends to cover a window opening and which folds back upon itself to overlie a wall adjacent to the window opening so as to expose the window opening.
Figure 6:
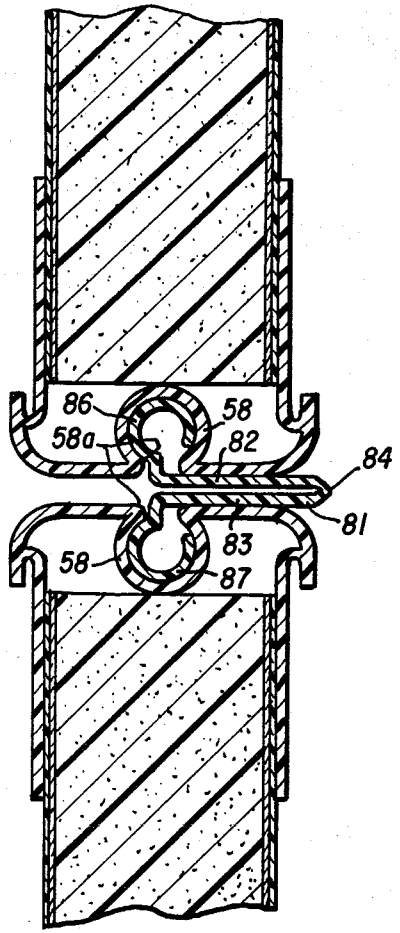
FIG. 6 is a cross section showing a hinge joining two panels allowing the panels to fold back upon one another.

The invention can be assembled at a plant or, in the alternative, can be marketed as a kit as is shown by the collection of components in FIG. 3. In either case, the components can be assembled to form an apparatus which is readily adaptable to windows of different sizes and configurations. The materials which comprise the invention can be easily cut with a blade such as a wallboard knife and can be easily sawed in a miter box. While a single shutter 15 is shown in FIG. 1, the single shutters can be combined to form shutter assemblies as shown in FIGS. 6, 7 and 9 which assemblies can be used to cover a single opening 11. Moreover, while the shutter 15 in FIG. 1 is slidably secured to top and bottom attachment rails 16, it is within the scope of this invention to slidably secure the shutter 15 to a pair of vertical side rails. On the other hand, it is also within the scope of this invention to hinge one edge of the shutter 15 to a single rail 16 and to secure the other edge of the shutter with a hook, VELCRO or a similar securing arrangement.

The shutter 15 depicted in FIG. 1 and assembled from the components of FIG. 3 is comprised of two primary structures, i.e., a panel, designated generally by the numeral 20, and a frame, designated generally by the numeral 21. The frame 21 extends around and encloses the peripheral portion of panel 20 so as to provide structure for mounting the shutter 15 on the wall 12 and so as to provide additional stiffening and protection for the panel. In almost all installations, the shutter 15 will be rectangular in shape, and the frame 21 composed of four separate lengths 21*a*, 21*b*, 21*c* and 21*d*. The separate lengths 21*a*–21*d* are cut in a miter box with 45° bevels at each end in order to provide a suitable frame in which all components of the frame lengths abut along a straight edge (see FIG. 2).

Figure 5:
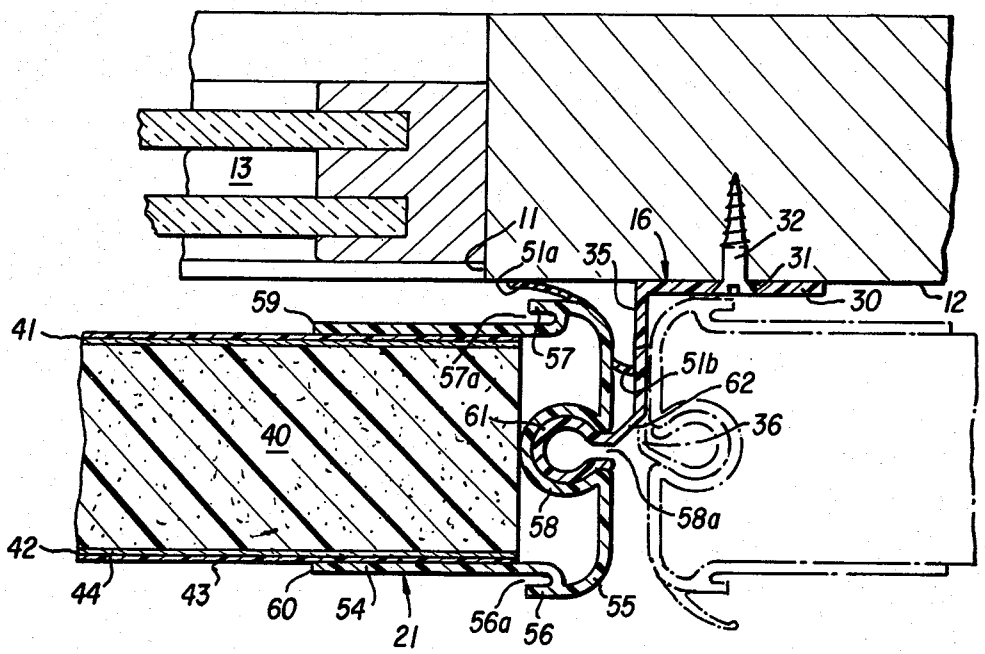
FIG. 5 is a top view, in section, showing a shutter hinged to an attachment rail positioned adjacent to a window opening.

As shown, for example, in FIGS. 1 and 5, the attachment rail 16 is substantially "L-shaped" in configuration and includes a first leg 30 having screw holes 31 therein through which mounting screws 32 are used to secure the attachment rail to the wall 12. The other leg 35 of the "L" extends at right angles to the leg 30 while the coupling structure 17 depends from the edge 36 of the leg 35.

Figure 4:
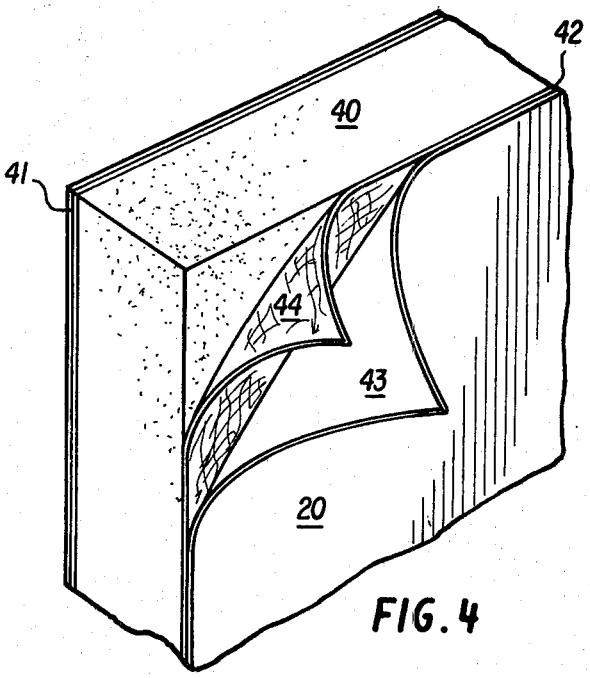
FIG. 4 is a perspective view showing layers forming a panel used in the shutter of FIGS. 1 and 2.
Figure 10:
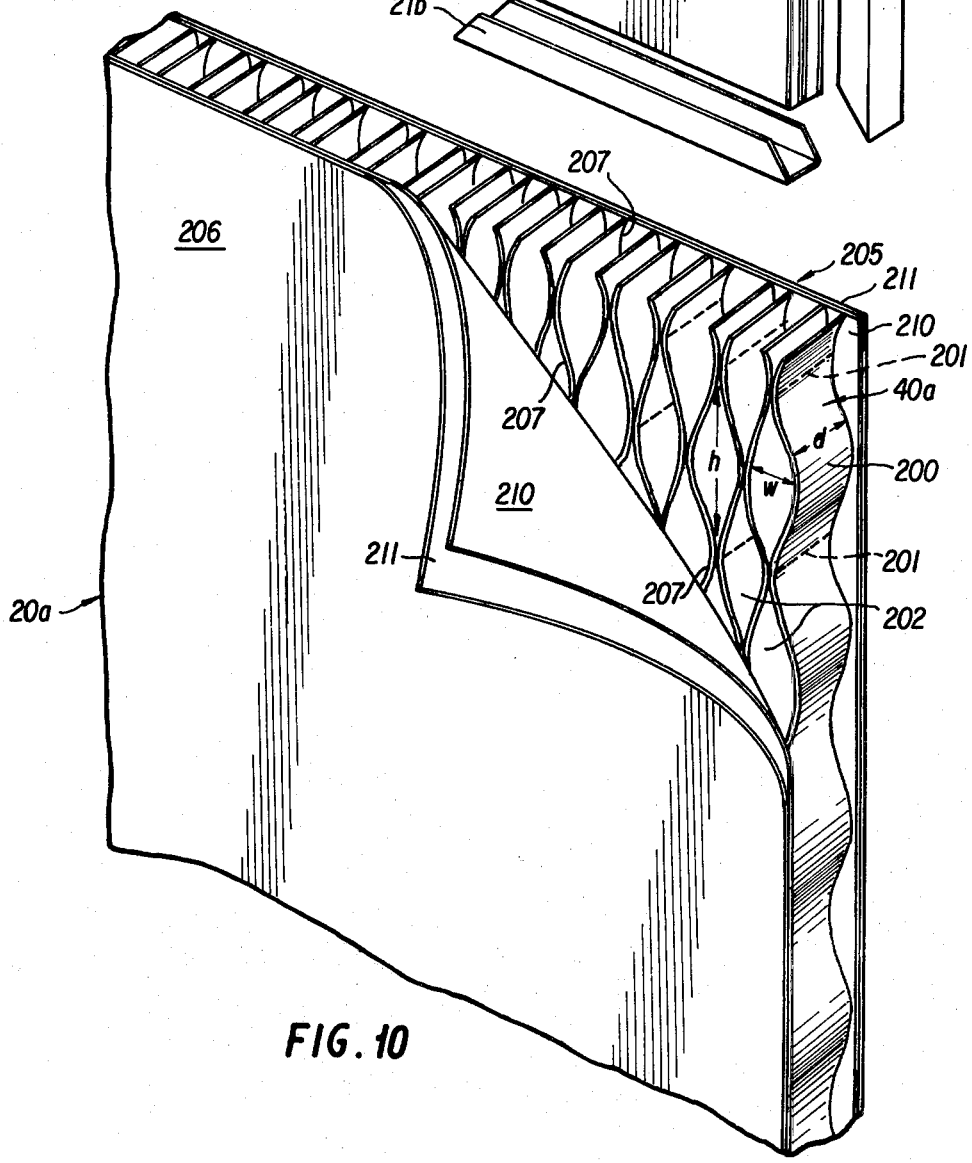
FIG. 10 is a perspective view of a honeycomb panel, with layers peeled back, which is an alternative to the foam panel of FIG. 4.

Considering one embodiment of the structure of the panel 20 more explicitly, it is seen in FIG. 4 that the panel 20 is a lamination composed of a core 40 sandwiched between a pair of skins 41 and 42 (an alternative honeycomb structure is shown in FIGS. 9 and 10.) The skins 41 and 42 include a relatively smooth outer layer 43 to which is adhered an array of strands 44. Preferably, the strands 44 are arrayed randomly and are composed of fiberglass. In accordance with one embodiment of the invention, the core 40 is a foam material of phenol-formaldehyde resin which is expanded between the skins 41 and 42 to form a rigid panel of a predetermined thickness. A one inch thick core of phenol-formaldehyde foam has a thermal resistance of R-5 and a high fire resistance. In comparison with other furnishing materials, phenol-formaldehyde resins are relatively benign when they finally do burn since they do not release smoke or noxious gases except for carbon monoxide. When protected by facing material, such as the skins 41 and 42, panels of phenol-formaldehyde foam reach a combustible state long after other furnishings burst into flame which minimizes the carbon monoxide problem.

An appropriate facing material utilizes an exterior sheet of a material such as No. 7115 chlorinated polyethylene which is covered on the inside with a fiberglass mat having the strands 44 of fiberglass distributed in a random array. The skins 41 and 42 are approximately 30 mil thick and the lamination which forms the panel 20 can be readily cut with a sheetrock knife. The structural integrity of the lamination is achieved upon expanding the phenol formaldehyde foam which bonds with the skins 41 and 42 as the lamination cures.

Figure 11:
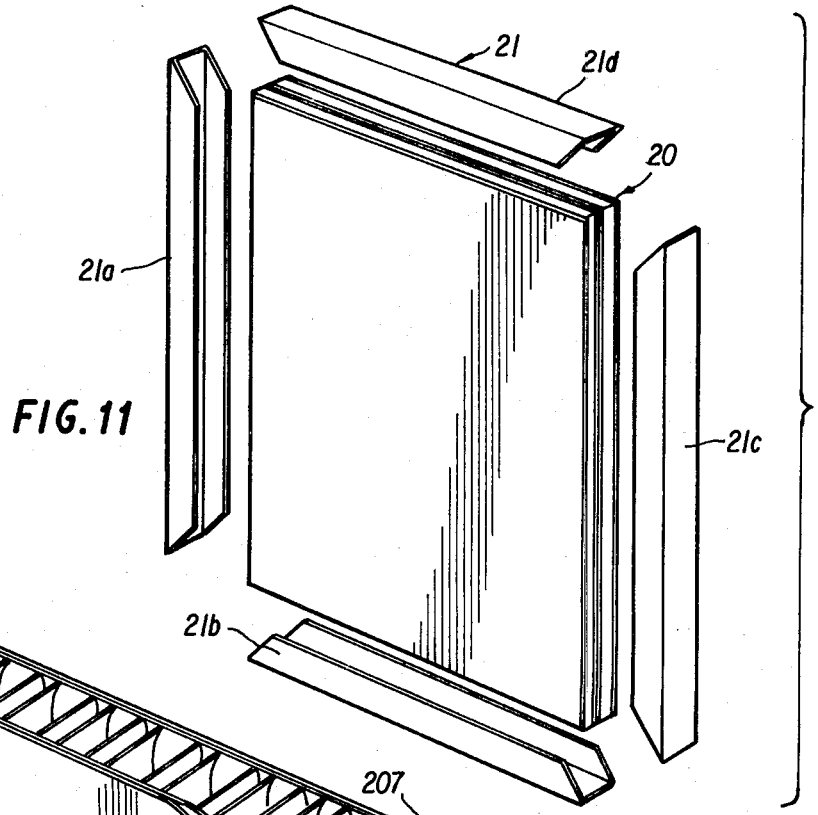
FIG. 11 is a perspective view of a pair of the honeycomb panels of FIG. 10 in abutting relationship and with lengths of the surrounding frame shown exploded around the periphery of the pair of panels.

Referring now to FIGS. 10 and 11, in which an alternative embodiment of the panel 20 is shown, instead of an expanded foam core, the panel 20 has a honeycomb core 40*a* composed of a plurality of strips 200 which undulate in a sinusoidal configuration and are adhered together along apexes identified by dotted lines 201. Foilfaced paper or cardboard is the preferable material for the honeycomb core 40*a*. The sinusoidal strips 200 define cells 202 therebetween which are sealed by skins 205 and 206 adhered to the edges 207 of the sinusoidal strips 200. A preferably ratio of maximum height to depth of each cell 202 of the honeycomb core 40*a* is about four to one with the maximum width being equal to the depth. For example, the height "h" of each cell 202 is two inches and the width "w" and depth "d" of each cell one-half inch. This provides a high enough aspect ratio in each cell 202 so that hot air rising in each cell bumps into falling cold air. The skins 206 and 207 may be a single layer of paper or cardboard or, preferably, may include a layer of foil 210 sandwiched between an outer cardboard or paper layer 211 and the edges 207 of the strip. A preferably material for the skins is foil Kraft laminate which has a low emittance surface. The resulting panel 20 may be cut with a knife or a fine-toothed saw, such as a hacksaw, to the desired dimension before being enclosed in a frame 21, as is shown for example in FIGS. 1 and 11.

It has been found that a pair of honeycomb type panels 20*a* nested back to back in the frame 21, as is shown in FIG. 11, provide a shutter with enhanced insulation properties.

Figure 2:
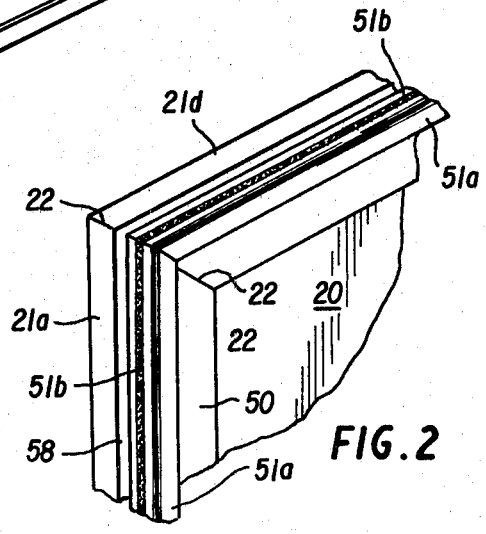
FIG. 2 is a perspective view of a corner of the back side of the thermal shutter shown in FIG. 1.

The frame 21 is assembled from lengths of extruded members each having a relatively stiff or hard portion 50 and relatively soft or flexible portions 51*a* and 51*b*. Upon assembling the kit of FIG. 3, the hard portion 50 is bonded to the laminated panel 20 and forms the frame for panel 20 as well as a rigid support to couple the panel 20 to the attachment rail 16. The soft portion 51*a* (see FIG. 2) is preferably in the form of a vane and forms a seal with the inner surface of wall 12 to prevent infiltration of air between the opening and room interior. The seal 51*a* extends all the way around the window and abuts that portion of the wall 12 adjacent to the periphery of the opening 11. In a similar fashion, the soft portion 51*b* forms a seal with the leg 35 (see FIG. 5). As is seen in FIG. 2, the soft portions 51*a* and 51*b* close at the mitered joints 22 so that infiltration of air at the corners of the shutter 15 is minimized.

As is seen best in FIG. 5, the frames 21 are generally U-shaped in cross section and have a first leg 53 which faces the wall 12 and window 13 when the shutter 15 is closed and a second leg 54 which faces the interior of the building when the shutter is closed. The first and second legs 53 and 54 respectively are joined to a bight 55 by curved flanges 56 and 57, respectively. The flanges 56 and 57 provide slots 56*a* and 57*a* for receiving a decorative sheet of fabric veneer or the like. The legs 53 and 54 are preferably extruded with a slight inward bias of their free edges 59 and 60. Consequently, the legs 53 and 54 can grip the panel 20 during assembly and will press against the panel so that adhesive applied on the inner surfaces will bond readily with the panel after the frame lengths 21*a*–21*d* have been properly positioned. Preferably, the frames 21 are extruded from polyvinyl chloride.

As is seen in the cross sectional FIGS. 5–9, the bight 55 has a groove 58 of generally circular cross section which projects inwardly between the legs 53 and 54. As is seen in FIGS. 1 and 3, the grooves 58 extend along the entire lengths of the frame members 21, and as seen in FIG. 5, for example, the grooves have relatively narrow openings 58*a*. The particular frame member or pair of frame members 21 of a shutter assembly which are used to attach the shutter to one or a pair of attachment rails 16, in either a hinged or slidable manner as described above, are joined to the rails by means of couplings 17 which slide into grooves 58 of the frame members.

The coupling between the attachment member 16 and frame member 21 is accomplished by sliding the tubular rib 61 through the groove 58 until the attachment rail is properly positioned with respect to the shutter 15. The attachment rail 16 is then secured by the screws 32 (or perhaps an adhesive) to the wall 12.

There are two approaches provided for moving the shutter 15 with respect to the opening 11 after the attachment rails 16 are secured to the wall 12. The first approach is to make the web 62 relatively thin in cross section with respect to the leg 35 and the tubular rim 61 so that the web forms a continuous hinge of reduced thickness and can flex and thus allows one to pivot the shutter 15 from the solid line position shown in FIG. 5 to the dotted line position. If the web 62 serves as a continuous hinge, then the entire mounting rail-hinge assembly 16–17 is preferably extruded from a polyolefin such as polypropylene.

If there is a molding (not shown) around the window 13, it may be desirable to mount the rail 16 outboard of the molding. When this is done, the leg 35 needs to be made wide enough so that when the shutter is closed, the flange 57 is spaced from the surface of the molding with the soft portion 51*a* abutting the molding to form an air seal therewith. Alternatively, the rail 16 can be mounted directly on the molding in which case the leg 35 has the same width as when configured to mount directly on the wall 12 when there is no molding present.

When using the shutters with sliding windows in which a pair of stationary sash rails (not shown) retains a window sash therebetween, the rail 16 can be mounted on a sash rail with the soft portion 51*a* abutting and sealing directly on the window sash.

The other basic approach depicted in FIG. 1 is simply to slide the shutter 15 with respect to a pair of attachment rails 16 so that the shutter 15 can be moved laterally to expose the window 13. The shutter 15 can then be left on portions of the mounting rails which extend past the opening 11 or simply removed completely from the mounting rails. The particular approach taken depends on the desires of the end user. It is apparent at this point that the mounting arrangement is quite flexible. For example, the shutter 15 can be pivoted adjacent to its top frame, or its bottom frame, or its side frame. Moreover, the shutter 15 may be slid vertically into and out of alignment with the opening 11 or may be slid horizontally. There are advantages to any of these approaches. If one desires to pivot the shutter 15, then only one attachment rail is necessary. On the other hand, if one desires to slide the shutter 15, then the shutter 15 can be easily positioned to partially expose the window 13. On the other hand, when the shutter 15 is pivoted, then it can be used to reflect or direct light entering through a window 13.

Figure 8:
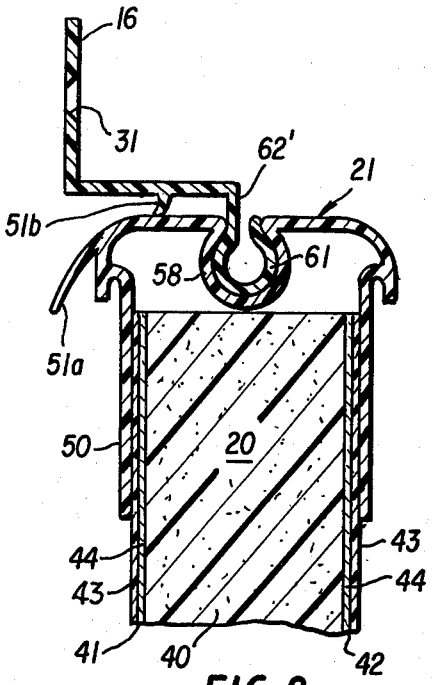
FIG. 8 is a sectional view showing a coupling means used with a thermal shutter which is slidably moved to cover a window opening.

When using the sliding arrangement, the webs 62 may be rigid such as the web 62' of FIG. 8 or may be flexible such as the web 62 of FIG. 5. If the webs are rigid such as web 62', then the shutter 15 is more likely to slide without binding. However, flexible webs 62, such as shown in FIG. 5, should be adequate for use with the sliding configuration. Of course, a distinct advantage to manufacturing only flexible webs 62 is that only one type of rail 16 needs to be extruded which minimizes considerably both manufacturing and distribution costs.

As was mentioned earlier, a primary consideration in the utilization of thermal shutters is temporary storage of the shutters when the shutters are not covering an opening 11. Since the shutters are closed once a day, they should be readily accessible. Ideally, the shutters should be an unobtrusive as possible. One way to accomplish this is to utilize a bi-fold shutter arrangement such as that shown in FIGS. 6, 7 and 9. This is accomplished by utilizing an extruded coupling, designated generally by the numeral 81, which has a pair of legs 82 and 83 joined by a continuous web 84 made of a material such as polyolefin that hinges the legs 82 and 83. Projecting from legs 82 and 83 are tubular ribs 86 and 87, respectively, which ribs are received in the circular grooves 58 in the bights 55 of frame members 21. In order to provide a bi-folding arrangement, the panels 15*a* must pivot clockwise with respect to one edge and counterclockwise with respect to the opposite edge. In the instant invention, this is accomplished by simply installing the bi-fold coupler 81 with the web 84 adjacent either the inside or outside surface of the shutters 15*a*. For either arrangement, the same components are utilized, and bi-folding is accomplished by simply reversing the orientation of web 84.

It will also be seen that by use of a shutter and attachment rail assembly, such as depicted in FIG. 5, as the first unit of a bi-fold arrangement, the interconnected sections of the bi-fold can be folded so as to lie back against wall 12 inside opening 11.

Another embodiment of a bi-fold shutter is shown schematically in FIG. 9. As there depicted, an assembly of shutters is arranged to form what is in effect a Roman shade which stacks at the top or bottom edge of the window opening. The bi-fold and Roman shade arrangements are easily constructed from the same "kit" components (see FIG. 3) as the sliding and pivoting arrangements.

The instant invention provides a low-cost, lightweight, movable, thermal window shutter for interior application which has high insulating characteristics and minimizes cold air infiltration. Furthermore, the shutter can be constructed of fire-resistant material. Moreover, the invention is easily installed by a homeowner or contractor by field assembly for an accurate fit. The kit shown in FIG. 3 may be assembled in numerous configurations to suit the taste, skill and needs of diverse end users.

The foregoing embodiments and examples are merely illustrative of the invention which is to be limited only by the following claims:

What is claimed is:

1. Apparatus for insulating openings through building walls; the apparatus comprising:

means for attaching the apparatus to the surface of the wall at a location adjacent to the periphery of the opening;

shutter means secured to the attaching means for covering said opening to provide a thermal barrier;

means for coupling said shutter means to said attaching means for selected movement relative thereto between the position covering the opening to a position displaced from said opening;

wherein said shutter means includes:

at least one panel having at least a core formed in an insulating configuration, which core has a surface for covering the opening and edges, at least one of which is positioned adjacent to said attaching means, and a frame attached adjacent to the edges and extending around the periphery of the panel, said frame comprising a relatively stiff portion to which the panel is secured and a relatively soft portion for forming a seal around the opening; wherein the stiff portion of the frame is a substantially U-shaped channel which in cross-section has a pair of legs connected by a bight which holds the legs in spaced relation, wherein the panel is received between the pair of legs, the relatively soft portion extending over the one leg which overlies the wall when the shutter is closed, and wherein the frame includes a groove with a relatively narrow opening and an expanded cross-section for receiving a complementary projection on the coupling means.

2. The apparatus of claim 1 wherein the core of said panel is a honeycomb structure sandwiched between a pair of skins.

3. The apparatus of claim 2 wherein the skins have an outer layer of sheet material and an inner layer of reflective material.

4. The apparatus of claim 2 or claim 3 wherein the honeycomb structure is formed of infrared reflective paper.

5. The apparatus of claim 1 wherein the core of said panel is a foam and wherein the panel further comprises a pair of skins between which the core is sandwiched, said skins including sheets of material and reinforcement, the reinforcement being secured to the sheets of material.

6. The apparatus of claim 1 wherein the core is an expanded phenolic resin and wherein the panel further comprises a pair of skins between which the core has been expanded, each of the skins comprising a thin sheet of material with an array of fiberglass strands distributed over the inner surface thereof for reinforcing the panel.

7. The apparatus of claim 6 wherein the sheets are chlorinated polyethylene.

8. The apparatus of claim 7 wherein the array of fiberglass strands is essentially random.

9. The apparatus of claim 1 wherein the stiff portion of the frame includes at least two sections, a first of which overlies at least one surface of the panel, and a second of which overlies the edges of the panel to provide surfaces to which the panel is secured and wherein the soft portion of the frame extends over said one section for sealing the opening while said second section includes means for attaching said coupling means.

10. The apparatus of claim 1 wherein the channel is formed of resilient material and wherein the legs of the U-shaped channel converge to define an opening at the free ends of the legs which is narrower than the width of the bight, whereby the U-shaped channel frictionally grips the panel before being permanently secured thereto.

11. The apparatus of claim 1 wherein the relatively soft portion is a resilient vane which extends from the juncture of the bight and one of the legs obliquely over the leg in spaced relation thereto whereby when the panel covers the opening, the vane is deflected by the portion of the wall adjacent to the periphery of the opening and is biased against the wall to effect a seal.

12. The apparatus of claim 11 wherein the attaching means is a rail which is substantially L-shaped in cross section and has a first leg secured against the wall and a second leg projecting out from the wall by a distance approximately the distance from the first leg of the frame to the groove for connecting the coupling means, and wherein the coupling means is connected to and extends from the second leg of the L-shaped rail.

13. The apparatus of claim 12 wherein the coupling means is integral with the second leg of the L-shaped rail and is connected thereto by a web of reduced longitudinal cross section to form a continuous hinge about which the frame and panel secured thereto can at least pivot one hundred eighty degrees to selectively extend to cover the opening or over the wall through which the opening occurs.

14. The apparatus of claim 11 further including a plurality of hinges and wherein the shutter comprises a plurality of panels joined to one another by the hinges, which hinges are received in the grooves.

15. The apparatus of claim 14 wherein each hinge comprises a pair of legs joined by a continuous integral web of reduced cross section, each leg having a projection extending generally normally therefrom which projection has a shape which complements the cross section of the grooves in the bights of the U-shaped channels joined thereby, wherein the hinge permits the panels to pivot at least one hundred eighty degrees with respect to one another to thereby lie along one another when folded and to cover the opening when unfolded.

16. The apparatus of claim 15 wherein the complementary projection on the coupling means is slidably received in the groove, whereby the shutter is moved relative to the opening by sliding the shutter.

17. The apparatus of claim 1 wherein the complementary projection on the coupling means is slidably received in the groove, whereby the shutter is moved relative to the opening by sliding the shutter.

18. The apparatus of claim 1 wherein the groove has a substantially circular configuration, as does the complementary projection, whereby the projection pivots within the groove when the shutter is moved between the position covering the opening and the position displaced from the opening.

19. Apparatus for insulating openings through building walls, the apparatus comprising:

means for attaching the apparatus to the surface of the wall at a location adjacent to the periphery of the opening;

shutter means secured to the attaching means for covering said opening to provide a thermal barrier;

means for coupling said shutter means to said attaching means for selected movement relative thereto between the position covering the opening to a position displaced from said opening;

wherein said shutter means includes:

at least one panel having at least a core formed in an insulating configuration, which core has a surface for covering the opening and edges, at least one of which is positioned adjacent to said attaching means, and a frame attached adjacent the edges and extending around the periphery of the panel, said frame comprising a relatively stiff portion to which the panel is secured and a relatively soft portion for forming a seal around the opening;

wherein the stiff portion of the frame is a substantially U-shaped channel which in cross-section has a pair of legs connected by a bight which holds the legs in spaced relation, wherein the panel is received between the pair of legs, the relatively soft portion extending over the one leg which overlies the wall when the shutter is closed, and wherein the frame includes a groove with a relatively narrow opening and an expanded cross-section for receiving a complementary projection on the coupling member, the bight having an additional soft portion thereon which effects a seal with the coupling member.

20. The apparatus of claim 19 wherein the channel is formed of resilient material and wherein the legs of the U-shaped channel converge to define an opening at the free ends of the legs which is wider than the width of the bight, whereby the U-shaped channel frictionally grips the panel before being permanently secured thereto.

21. The apparatus of claim 19 wherein the relatively soft portion is a resilient vane which extends from the juncture of the bight and one of the legs obliquely over the leg in spaced relation thereto whereby when the panel covers the opening the vane is deflected by the portion of the wall adjacent to the periphery of the opening and is biased against the wall to effect a seal.

22. The apparatus of claim 21 wherein the attaching means is a rail which is substantially L-shaped in cross section and has a first leg secured against the wall and a second leg projecting out from the wall by a distance approximately the distance from the first leg of the frame to the groove for connecting the coupling means, and wherein the coupling means is connected to and extends from the second leg of the L-shaped rail and the additional soft portion effects a seal with the second leg.

23. The apparatus of claim 22 wherein the coupling means is integral with the second leg of the L-shaped rail and is connected thereto by a web of reduced longitudinal cross section to form a continuous hinge about which the frame and panel secured thereto can at least pivot one hundred eighty degrees to selectively extend to cover the opening or over the wall through which the opening occurs.

24. The apparatus of claim 21 further including a plurality of hinges and wherein the shutter comprises a plurality of panels joined to one another by the hinges received in the grooves.

25. The apparatus of claim 24 wherein each hinge comprises a pair of legs joined by a continuous integral web of reduced cross section, each leg having a projection extending generally normally therefrom which projection has a shape which complements the cross section of the grooves in the bights of the U-shaped channels joined thereby, wherein the hinge permits the panels to pivot at least one hundred eighty degrees with respect to one another to thereby lie along one another when folded and to cover the opening when unfolded.

26. An apparatus for insulating a window positioned in an opening through the wall of a building, the apparatus being distributed in form for ultimate sizing, assembly and installation, by a user, the apparatus for a single window comprising:

shutter means including a panel having surface area at least greater than the surface area of the window; said panel means comprising a core of fire resistant foam sandwiched between a pair of fabric skins, said panel being readily cut with a blade for proper sizing;

said shutter means further including frame members for mounting around the outer periphery of the panel means, said frame members including a hard portion of substantially U-shaped configuration having first and second opposed legs separated by a bight wherein the core of the panel is received between the legs upon assembly of the frame members with the panel; wherein connecting means is positioned on the bight of each frame member and wherein the frame member includes a continuous projecting soft portion disposed on one leg for engaging the surface of the wall adjacent the opening to seal the opening, wherein mitering of the frame members at the ends thereof results in abutment of the continuous soft portions of adjacent frame members;

at least one L-shaped mounting strip with a first leg having mounting screw holes therethrough at spaced intervals therealong for attachment of the strips adjacent the window and a second leg projecting perpendicular to the first leg; and hinge means pivoted on the second leg of the mounting strip for coupling with the connecting means on the frame members to couple the shutter to the mounting strip, whereby the shutter pivots about the second leg to selectively overlie either the wall or the window in the opening with the soft portion of the frame in sealing relationship with the opening.

27. The apparatus of claim 26 wherein the shutter includes a plurality of panels each having a periphery surrounded by frame members wherein a secondary hinge means is provided for coupling adjacent ones of the plurality of panels the secondary hinge means having pivot area outboard of the surface area of each panel whereby each hinge pivots about the pivot area thereof allowing the panels to swing through one hundred eighty degrees with respect to one another to either extend from one another for insulating the window or to extend back along one another to fold the shutter.

28. An apparatus for insulating a window positioned in an opening through the wall of a building, the apparatus being distributed in form for ultimate sizing, assembly and installation, by a user, the apparatus for a single window comprising:

shutter means including a panel having surface area at least greater than the surface area of the window; said panel means comprising a core of foilfaced paper honeycomb sandwiched between a pair of skins, said panel being readily cut with a blade for proper sizing;

said shutter means further including duel durometer frame members for mounting around the outer periphery of the panel means, said frame members including a hard portion of substantially U-shaped configuration having first and second opposed legs separated by a bight wherein the core of the panel is received between the legs upon assembly of the frame members with the panel; wherein connecting means is positioned on the bight of each frame member and wherein the frame member includes a first continuous projecting soft portion disposed on one leg for sealing the opening and a second continuous projecting soft portion disposed on the bight, wherein mitering of the frame members at the ends thereof results in abutment of the continuous soft portions of adjacent frame members;

at least one L-shaped mounting strip with a first leg having mounting screw holes therethrough at spaced intervals therealong for attachment of the strips adjacent the window and a second leg projecting perpendicular to the first leg; and hinge means pivoted on the second leg of the mounting strip for coupling with the connecting means on the frame members to couple the shutter to the mounting strip, whereby the shutter pivots about the second leg to selectively overlie either the wall or the window in the opening with the first soft portion of the frame in sealing relationship with the opening and the second soft portion sealing against the second leg of the mounting strip.

29. The apparatus of claim 28 further including a reflective surface sandwiched between the skins and infrared reflective paper honeycomb.

30. The apparatus of claim 19 wherein the groove has a substantially circular configuration, as does the complementary projection, whereby the projection pivots within the groove when the shutter is moved between the position covering the opening and the position displaced from the opening.

* * * * *